United States Patent [19]

Barthel et al.

[11] 4,453,593

[45] Jun. 12, 1984

[54] OIL-HEATED ROLLER

[75] Inventors: Sven Barthel, Nesbru; Gunnar Eriksen, Ostenstad, both of Norway

[73] Assignee: Thune-Eureka S/S, Tranby, Norway

[21] Appl. No.: 913,075

[22] Filed: Jun. 6, 1978

[30] Foreign Application Priority Data

Jun. 6, 1977 [NO] Norway ..... 771969

[51] Int. Cl.[3] ..... F28D 11/02

[52] U.S. Cl. ..... 165/89; 165/169; 29/157.3 R

[58] Field of Search ..... 165/89, 90, 169; 34/108–128

[56] References Cited

U.S. PATENT DOCUMENTS

| | | | |
|---|---|---|---|
| 2,932,091 | 4/1960 | Day | 165/89 X |
| 2,936,158 | 5/1960 | Ramundo | 165/89 |
| 2,972,472 | 2/1961 | Kunold | 165/89 |
| 3,217,795 | 11/1965 | Cirrito | 165/90 |

*Primary Examiner*—Albert W. Davis, Jr.
*Attorney, Agent, or Firm*—Young & Thompson

[57] ABSTRACT

A roller having channels in the roller shell for a flow medium. The roller has an inner, tight, homogeneous shell, an outer shell, and intermediate ribs projecting out from the inner shell and sealed to both inner and outer shells to form the said channels.

2 Claims, 3 Drawing Figures

OIL-HEATED ROLLER

Figure 1:
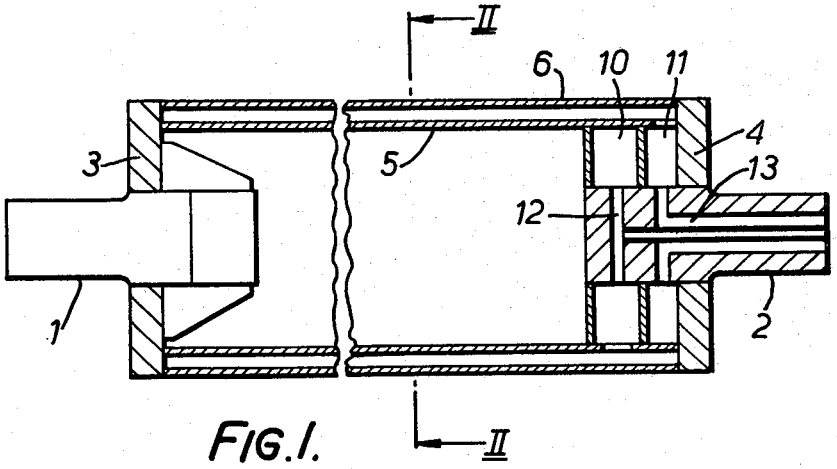

The invention relates to a roller having channels in the roller shell for a flow medium which affects the surface temperature of the roller.

The invention has been developed in answer to the problems that have been experienced with oil-heated rollers used for finishing treatment of wires and felts in paper-making machines, primarily, the so-called stretching machine roller. For example, for temperature fixation of a paper machine wire, precise temperature control is required, and for this purpose the roller used is heated with oil which flows in longitudinal channels built into the shell. The oil enters into a passage-way at one end of the roller, flows along the shell to the other end and over into an adjacent passageway, which then carries the oil back to the inlet end of the roller. Several such pairs of passageways or channels are consecutively disposed about the circumference of the roller.

One problem with such rollers has been to obtain a structurally practical construction of the roller shell with the required channels. In one known embodiment, thin-walled channel shells are welded to the interior of the roller shell itself. Because these thin-walled channel shells are affected more quickly by the oil temperature than the thicker outer shell, high thermal stresses occur which can cause cracks in the ends of the channels, which in turn leads to oil leakage into the interior of the roller. This can result in so-called blow-outs, with the danger this entails for the personnel attending the machine.

The purpose of the invention is to develop a roller in which, when heating the roller with oil, for example, the thermal stresses will be more moderate such that fissures are avoided, while at the same time the advantages of the known embodiment with respect to even heat distribution are retained. In particular, it is the aim of the invention to provide a roller structure in which the risk of leaks in the interior of the roller is completely eliminated, so that blow-outs cannot occur.

To achieve this purpose, the roller of the invention is constructed with a double shell, the inner shell being a tight and homogeneous member, and ribs are disposed between and sealed to both the inner and outer shells to form the desired channels for the flow medium.

This type of embodiment ensures that flow medium cannot leak into the interior of the roller, because the inner roller shell is a homogeneous and tight structure. Thermal stresses will be more moderate because both the inner and outer shells will assume the temperature of the flow medium equally quickly, unlike the previously known embodiment. The inner shell and the outer shell can be of approximately the same thickness, which will give even heat distribution in all directions and equal longitudinal expansion. The entire cross section can be utilized as the bearing structure. The construction of the roller is also easier and simpler, because it is easier to carry out the necessary work from the outside rather than, as required in the previous embodiment, from the inside, with respect to, for example, the welding of the components. A disadvantage of the aforesaid previously-known embodiment is that the diameter of the roller had to be large enough to permit personnel to crawl into it. When the inner shell is an integral structure, no such limit applies.

According to the invention, therefore, a roller is provided having channels in the roller shell for a flow medium which affects the surface temperature of the roller, said roller being characterized by an inner, sealed, homogeneous shell, an outer shell, and intermediate ribs projecting out from the inner shell and sealed to both the inner and outer shells to form the desired channels for the flow medium.

The sealed connections are perferably welded joints. A preferred embodiment, which is especially adapted for use with a stretching machine, is constructed with ribs running lengthwise along the shell and with an outer shell which is composed of longitudinal cylindrical shell segments, each of which, in the direction of the roller's circumference, has a width which spans the space between adjacent ribs. This type of structure facilitates the construction of the roller, because the structure is rendered easily accessible for welding the ribs to the inner shell and welding the cylindrical shell segments together, not only to each other, but also simultaneously to the ribs. In this embodiment, the individual channels, in a manner known per se, are preferably connected to one another in pairs, such that the flow medium enters one channel at one end of the roller, flows over into the other channel in the pair at the other end of the roller, and returns to the first end.

Figure 2:
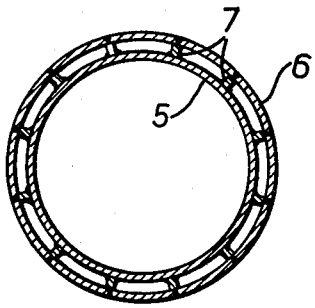
Figure 3:
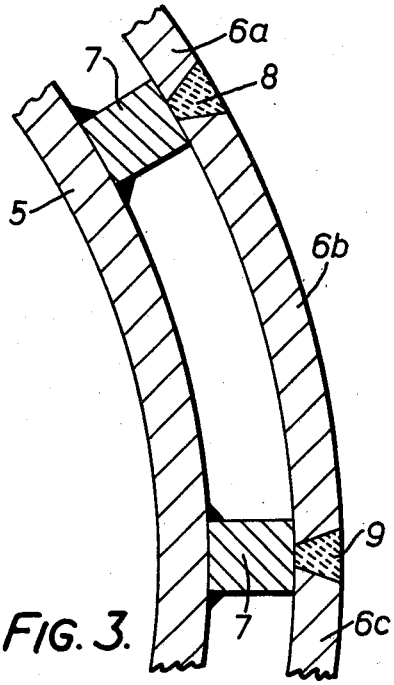

The invention will be further elucidated with reference to the drawing, where:

FIG. 1 is a longitudinal cross section through a roller made according to the invention, FIG. 2 is a cross section along line II—II of FIG. 1, and FIG. 3 shows a section of FIG. 2 on a larger scale.

The roller of FIG. 1 is constructed with a journal 1 in one end and a journal 2 in the other end. The journals 1, 2 are welded onto respective end plates 3, 4. A sealed and homogeneous inner shell 5 and an outer shell 6 are welded between the end plates 3, 4. Between these shells 5 and 6, longitudinal ribs 7 are provided which project out from the exterior side of the inner shell.

The inner shell, as mentioned previously, is constructed as a homogeneous, integral structure, and can, for example, consist of a sheet rolled into cylindrical shape and having a longitudinal weld seam which can be applied and controlled to ensure that the seam forms a tight joint. Ribs 7 are then welded onto the exterior of the inner shell 5, see FIG. 3. The outer shell is constructed of longitudinal cylindrical shell segments *6a*, *6b*, *6c*. These segments are welded together with longitudinal weld seams 8, 9 which are done in such a way that the outer shell is simultaneously welded to the respective ribs 7.

Two manifolds 10, 11 are formed at one end of the roller, in a manner known per se. The manifold 10 communicates with every other space between the ribs 7, while the manifold 11 communicates with the remaining, alternate spaces. In this way, pairs of channels are formed through which the flow medium, in this case, oil, can flow. The oil enters into a channel between two ribs 7 and flows along the roller shell and into an adjacent channel, where it is carried back to the other manifold and out of the roller. The respective manifolds 10 and 11 are connected to supply lines through the respective passageways 12, 13 in the journal 2.

Having described our invention, we claim:

1. A roller having channels in the roller shell for a flow medium which affects the surface temperature of the roller, characterized by an inner, tight, homogeneous shell of sheet metal, an outer shell of sheet metal of about the same thickness as the inner shell, and intermediate ribs projecting out from the inner shell and welded to both the inner and outer shells to form the desired channels for the flow medium, the ribs running lengthwise along the roller shell, the outer shell being composed of longitudinal shell segments each of whose outer and inner surfaces are cylindrical, and each of which, in the direction of the roller's circumference, has a width which spans the space between two adjacent ribs.

2. A roller according to claim 1, characterized in that the channels, in a manner known per se, are arranged in pairs, each pair of channels having an inlet for the flow medium in one of said channels at one end of the roller, a connection between the two channels of the pair at the other end of the roller, and an outlet from the second channel near the inlet end of the first channel.

* * * * *